United States Patent [19]

Sacchetti

[11] 4,186,677

[45] Feb. 5, 1980

[54] AUTOMATIC COLOR BOBBIN CHANGER

[76] Inventor: Alfred D. Sacchetti, 1903 Sharon Rd., Meadowbrook, Pa. 19046

[21] Appl. No.: 903,439

[22] Filed: May 8, 1978

[51] Int. Cl.[2] ..... D05B 57/26

[52] U.S. Cl. ..... 112/186

[58] Field of Search ..... 112/186, 180, 188, 196, 112/163, 79 R, 79 A

[56] References Cited

U.S. PATENT DOCUMENTS

| | | | |
|---|---|---|---|
| 2,690,725 | 10/1954 | Schumann et al. | 112/186 |
| 2,808,795 | 10/1957 | Wortham | 112/186 X |
| 3,376,838 | 4/1968 | Schiffmacher et al. | 112/186 |
| 4,002,130 | 1/1977 | Rovin et al. | 112/186 X |

*Primary Examiner*—Werner H. Schroeder
*Assistant Examiner*—Andrew M. Falik
*Attorney, Agent, or Firm*—Caesar, Rivise, Bernstein & Cohen, Ltd.

[57] ABSTRACT

An automatic color bobbin changer for attachment to a sewing machine, the automatic color bobbin changer having first and second grasping fingers to cooperate together and detach a first bobbin case from a sewing machine and deliver the first bobbin case to a storage area for further use or discarding. The first and second grasping fingers also function in the preferred embodiment to pick up a second bobbin case having thread of the same or different color from the storage area and deliver the second bobbin case into operative engagement with the sewing machine.

8 Claims, 17 Drawing Figures

AUTOMATIC COLOR BOBBIN CHANGER

BACKGROUND OF THE INVENTION

1. Field of the Invention

This application relates to an automatic color bobbin changer and has as its objective the provision of a new and improved apparatus of this general class.

An important purpose of the present invention is to provide an automatic color bobbin changer device that can be easily secured to a conventional sewing machine without making any change in the sewing machine. In particular, the adaptation of the present invention to a sewing machine can be completed in 15 minutes or less. It is contemplated that the device of the present invention can also be secured to automated sewing machines.

Under present practice, bobbins or bobbin cases are removed by the operator in a series of finger manipulations. The bobbin case is provided with a spring loaded latch and one of the advantages of the present invention is that it is effective with bobbin cases as presently constituted without requiring that a bobbin case of special construction be provided in order to remove the bobbin case manually. The spring loaded latch is raised in manual procedures by action of an index finger with the thumb acting as a backup. Once the latch is raised, the thumb of the forefinger grip the latch and pull the bobbin out.

The foregoing is a time consuming and tedious effort which is not only eliminated by the present invention, but the device of the present invention performs the operation of removing the old bobbin case and inserting a bobbin case of desired color thread in 2 to 4 seconds. The manual operation normally takes 30 seconds and is quite tedious as well as annoying to the operator who has to stop work in order to make the change. There is also the possibility of operator error in color selection, particularly with partially used bobbins.

Moreover, the device of the present invention may be coupled together with the automatic thread changer of U.S. Pat. Nos. 4,036,157 and 4,075,958.

2. Description of the Prior Art

Prior automatic devices have not had the advantages of the present invention. The devices of Schumann U.S. Pat. Nos. 2,690,725 and 2,733,676 require the use of a specially constructed bobbin case wherein the latch hinge has been completely removed from the bobbin case. Moreover, the Schumann devices cannot change colors and are effective only in removing and discarding an empty bobbin as compared with the present invention that is operative with both the empty bobbin as well as a partly full bobbin. With the Schumann devices, a completely empty or a partly used bobbin is ejected from the sewing machine by hook-type means. Schumann fails to show an apparatus which is capable of automatically reintroducing a partly used bobbin to the sewing machine at a later time when needed.

In the bobbin changing device of U.S. Pat. No. 3,747,547 it is necessary to provide a bobbin of special design and such device is not operative with a conventional bobbin.

Accordingly, it is an object of the present invention to provide an automatic color bobbin changer which is operative with a conventional bobbin to achieve the changing of an empty or partly full bobbin at an extremely fast rate of speed.

Yet another object of the present invention is to provide an automatic color bobbin changer which can remove from the sewing machine a partly full bobbin and later re-insert such partly full bobbin in the sewing machine when needed.

SUMMARY OF THE INVENTION

The automatic color bobbin changer of the present invention is controlled by a control circuit which upon signal will remove any empty bobbin case from the sewing machine and replace it with a full bobbin case. A sensing device (of known construction) automatically stops the sewing machine to allow removal of the bobbin case and to replace it with a full bobbin case of the same color. Also, the bobbin changer of the present invention can be used to change color. This can occur anytime the operator wishes to change color. Thus, the operator stops the sewing machine and then activates the automatic color bobbin changer of this invention to remove the bobbin case having thread of a first color and to replace it with a bobbin case having thread of a second color.

Moreover, the automatic color bobbin changer of the present invention comprises first and second grasping means (fingers), means to open and close the grasping means and means to move the first and second grasping means between the sewing machine and the storage area.

The opening and closing as well as the movement of the first and second grasping means is, in the disclosed specific embodiment, achieved and controlled by first and second cam means.

Moreover, in the disclosed specific embodiment of the invention, the first and second grasping means are caused to rotate as a unit after grasping a bobbin case by a third cam means to facilitate delivery of a bobbin case to and from the storage area.

Other objects and many of the attendant advantages of this invention will become more apparent by reference to the attached drawings wherein:

DESCRIPTION OF THE PREFERRED EMBODIMENT

Figure 1:
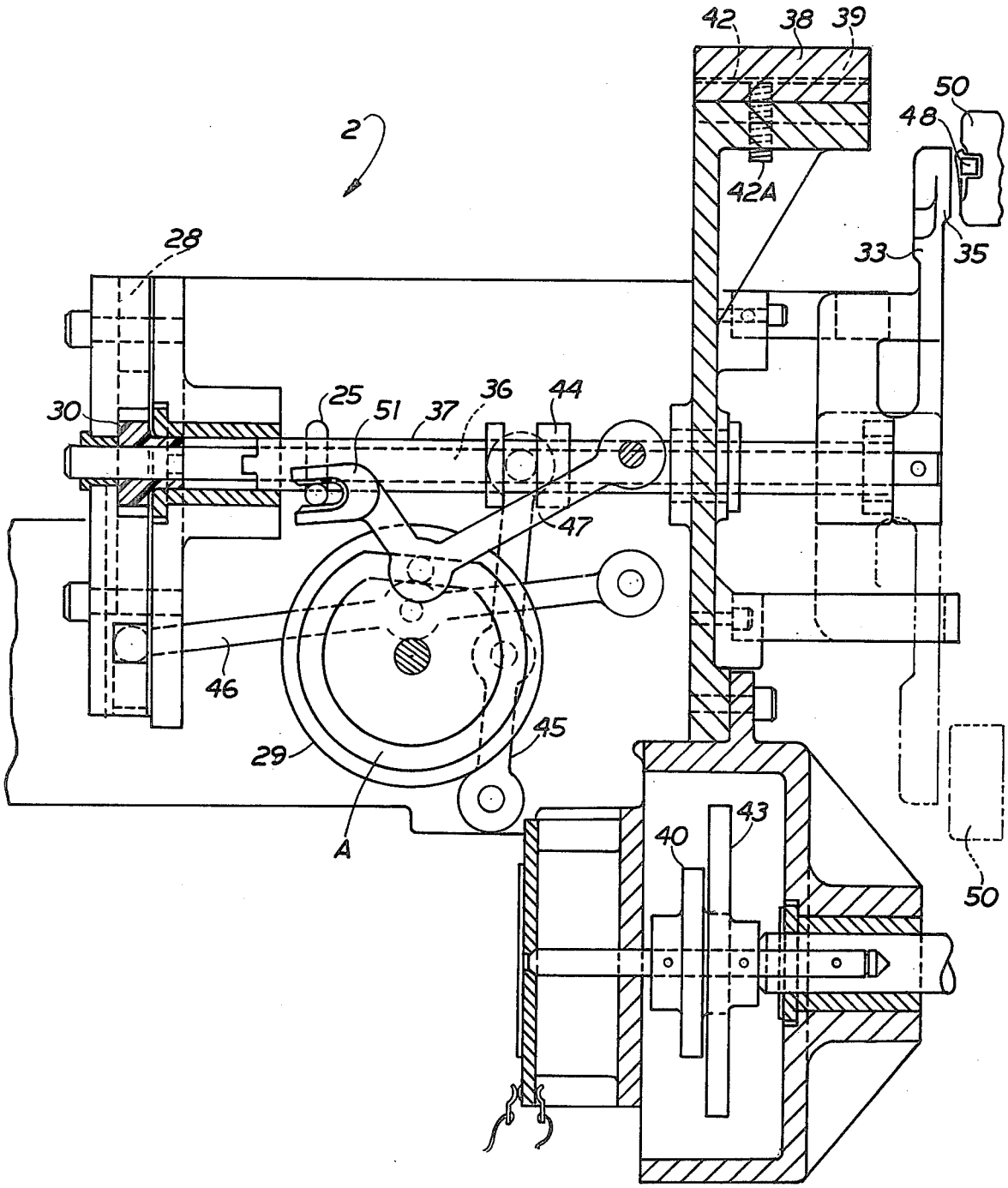
FIG. 1 is a vertical sectional view showing the automatic color bobbin changer of the present invention.

Referring now in greater detail to the various figures of the drawing wherein like reference characters refer to like parts there is shown generally at 2 in FIG. 1 an automatic color bobbin changer embodying the present invention.

Figure 2:
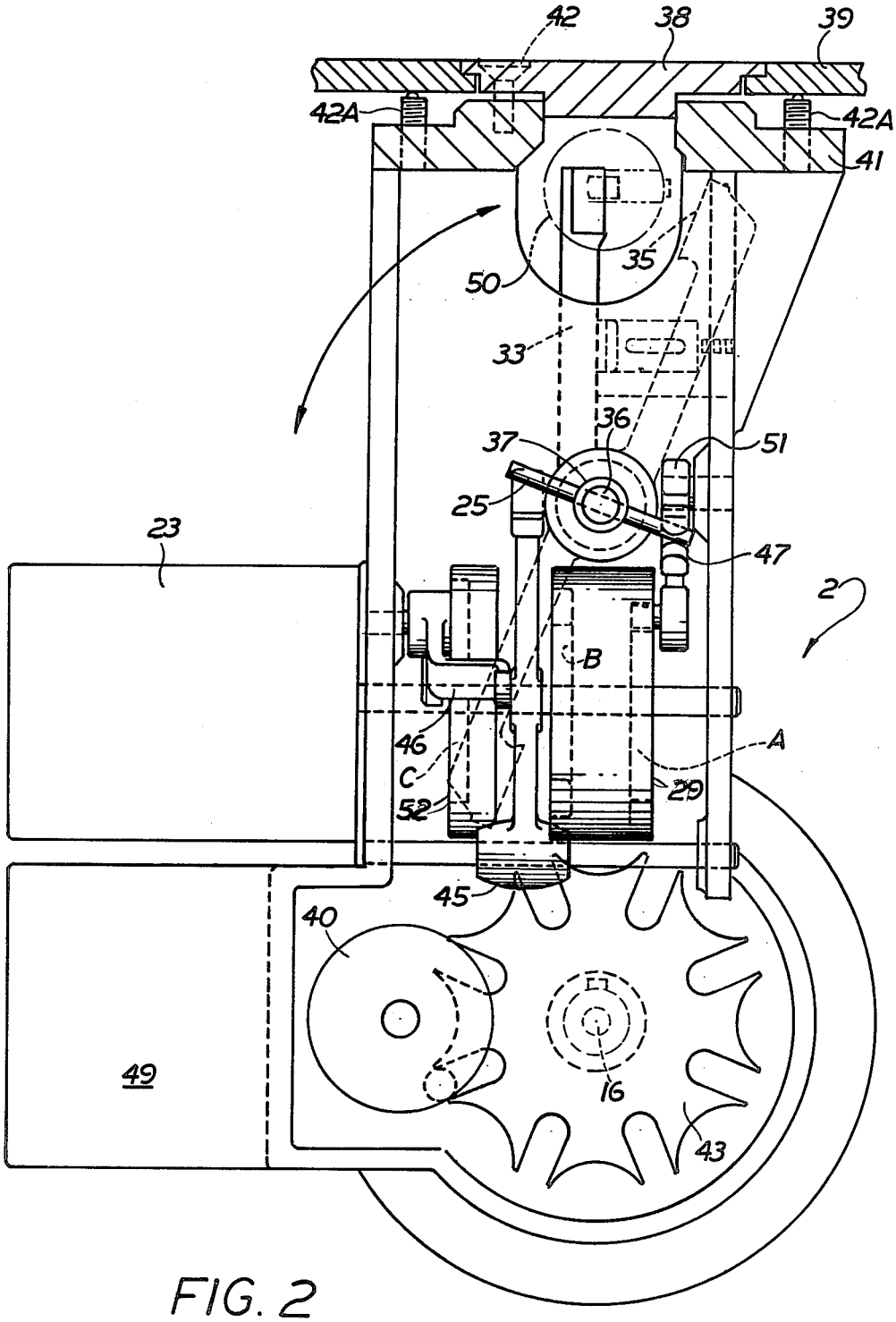
FIG. 2 is a vertical sectional view taken generally through FIG. 1.
Figure 3:
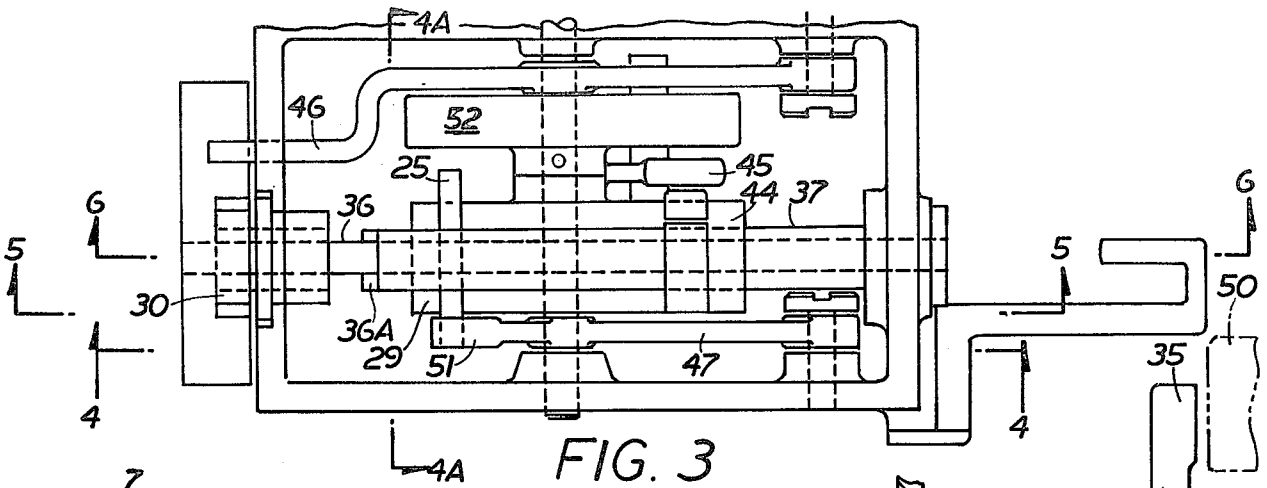
FIG. 3 is a plan view taken generally through the upper portion of FIG. 1, FIGS. 4 and 5 are sectional views taken along the lines 4—4 and 5—5 of FIG. 3.

Attention is called to FIG. 2 which shows the attachment of automatic bobbin changer 2 to a conventional sewing machine. This is achieved by removing the extending cover plate of the sewing machine and replacing it with a clamp plate 38 that fits in the opening adjacent the bobbin access hole. As shown in FIG. 2, the clamp plate 38 is dropped in the access hole and lays flush with the working surface 39 of a sewing machine. The clamp plate 38 has pre-drilled screw holes, or screw holes may be simply drilled through the clamp plate 38 so as to be aligned with threaded tapped openings in the bobbin changer plate 41. Screws 42 are then inserted through the openings in the clamp plate 38 to engage the tapped holes in the plate 41. This creates a squeezing action between the clamp plate 38 and the bobbin changer plate 41. Thus, the automatic bobbin changer of the present invention is tightly secured to the clamp plate 38 in a clamping action. Jack screws 42*a* may be used in connection with the bobbin changer to adjust for differences in casting thickness in the access hole area.

Figure 11:
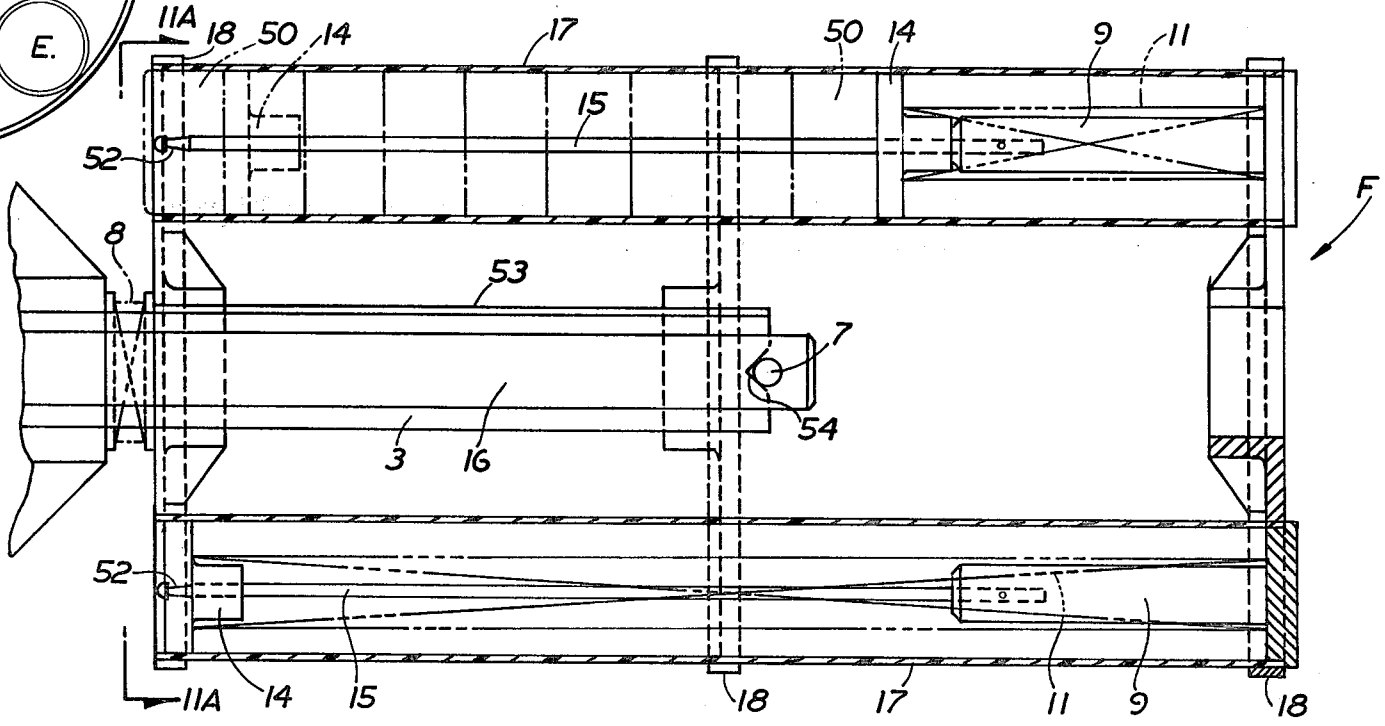
FIG. 11 is a sectional view showing the entire cartridge.
Figure 11A:
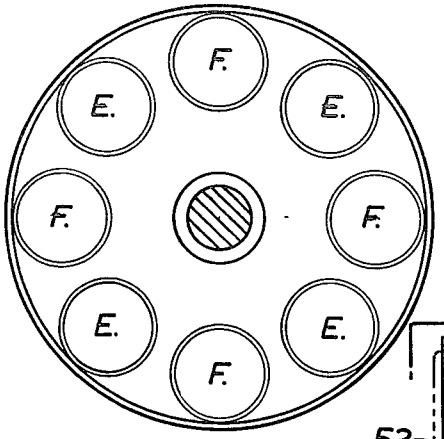
FIG. 11A is a sectional view taken along the lines 11A—11A of FIG. 11.
Figure 12:
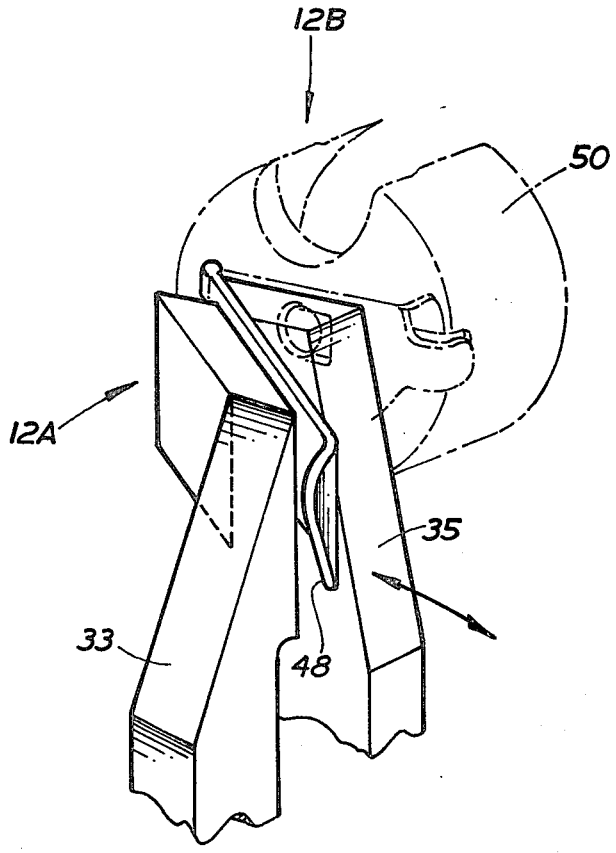
FIG. 12 is a fragmentary three-dimensional view showing the operation of the movable and stationary finger in grasping the latch of a bobbin case.
Figure 12B:
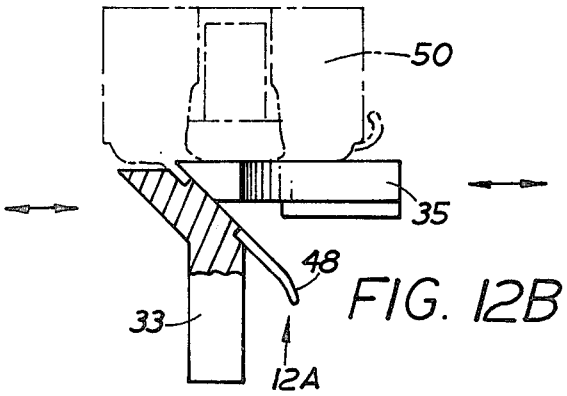
FIG. 12B is a plan view, partly in section showing one of the fingers in contact with an extended latch of the bobbin case.
Figure 12A:
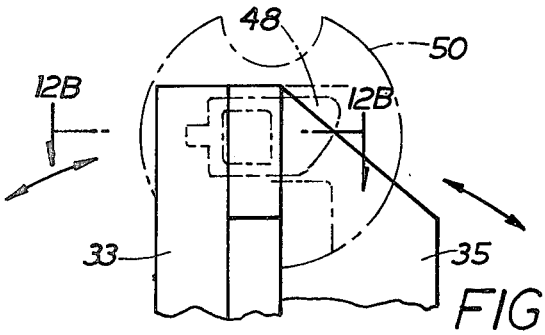
FIG. 12A is a front view look directory into the bobbin case and showing the fingers in close proximity to the bobbin case.

At this early stage in the description of the invention, the action of the bobbin changer device of the present invention can be understood by reference to FIG. 12 which shows the grasping action of stationary finger 33 and pivotable finger 35. These two fingers serve to grasp the latch 48 of a conventional bobbin case 50. By virtue of the action of the bobbin changer of the present invention, the bobbin case 50 is removed from operative connection to a sewing machine, with the bobbin case 50 then being transferred by the carrying action of fingers 33 and 35 to a storage cartridge. The old bobbin case 50 is delivered to the storage area of cartridge 17. The fingers 33 and 35 now grasp the latch of a new bobbin case 50, followed by the action of fingers 33 and 35 to transfer the new bobbin case to operative connection with the sewing machine. The cartridge 17 is best seen in FIGS. 11 and 12.

Moreover, the old bobbin case 50 can be observed in the right-hand corner of FIG. 1 with the fingers 33 and 35 serving to remove the old bobbin case 50 from operative connection with the sewing machine, followed by the rotation of 180° to bring the bobbin case down to the phantom position of FIG. 1. At this point, the fingers 33 and 35 serve to deliver the bobbin case 50 to the cartridge 17 by disposing the bobbin case 50 in one of the chambers of the cartridge 17. The cartridge 17 is then caused to rotate under the control circuit in order to deliver a new bobbin case 50 having the thread of desired color to the fingers 33 and 35. These fingers grasp the new bobbin case 50 and ultimately rotate it for 180° and then move the new bobbin case into operative connection with the sewing machine.

From the foregoing, it can be seen that the fingers 33 and 35 have three distinct movements, keeping in mind that the finger 35 is pivotable whereas the finger 33 is stationary, in the sense that it is not pivotable.

The actual sequence of operation of the fingers 33 and 35 in order to remove the bobbin case 50 from the sewing machine, deliver the old bobbin case to the cartridge 17, pick-up a new bobbin case from the cartridge 17 and deliver the new bobbin case and install it in the sewing machine will now be described.

The fingers 33 and 35, or grasping means, are closely adjacent the old bobbin case 50 (the one to be removed from the sewing machine) at the start of the cycle. The fingers 33 and 35 are normally biased to the open position and are located 1/16 of an inch (0.3175 cm) away from the latch 48 of the bobbin case 50. The open fingers now move in for 1/16 of an inch (0.3175 cm) to the bobbin case 50 so that latch 48 is grasped in the manner of FIG. 12. This occurs in a two step movement whereby the open fingers 33 and 35 first move for the distance of 1/16 of an inch (0.3175 cm) in toward the bobbin case 50 and then the pivotable finger 35 moves toward the finger 33 to grasp latch 48 as shown in FIG. 12. It will be appreciated that the fingers 33 and 35 are slightly offset from each other in order to give the grasping action of FIG. 12.

The closed fingers 33 and 35 now move ⅝ of an inch (1.5875 cm) away from their initial position so as to remove the bobbin case 50 completely from its operative connection with the sewing machine. The closed blades with the bobbin case now rotate 180° to the lower position of FIG. 1 and then move inwardly toward cartridge 17 for ⅝ of an inch (1.5875 cm). This latter movement has the effect of disposing the old cartridge 50 in a chamber of the cartridge 17. The finger 35 now moves to its open position so that the fingers 33 and 35 may be regarded as being in the open condition thereby releasing the old bobbin case 50. The open fingers 33 and 35 then move backwardly 1/16 of an inch (0.3175 cm) away from the cartridge 17. The entire cartridge 17 now rotates so as to present the desired new bobbin case closely adjacent to the open fingers 33 and 35. The process now repeats itself. The fingers move in 1/16 of an inch (0.3175 cm) and close about the latch of the new bobbin case. The closed fingers then move away from the cartridge 17 for ⅝ of an inch (1.5875 cm), followed by rotation for 180° so that the new bobbin case is now located closely adjacent to the bobbin case socket of the sewing machine. The closed fingers then move inwardly ⅝ of an inch (1.5875 cm) to deliver the new bobbin case to the sewing machine. The fingers open and then are retracted to 1/16 of an inch (0.3175 cm) to complete the change of the bobbin case.

All of the foregoing action occurs in approximately 2 to 4 seconds.

It will be seen that the fingers 33 and 35 are actuated by Cam Tracks A, B and C.

Figure 4:
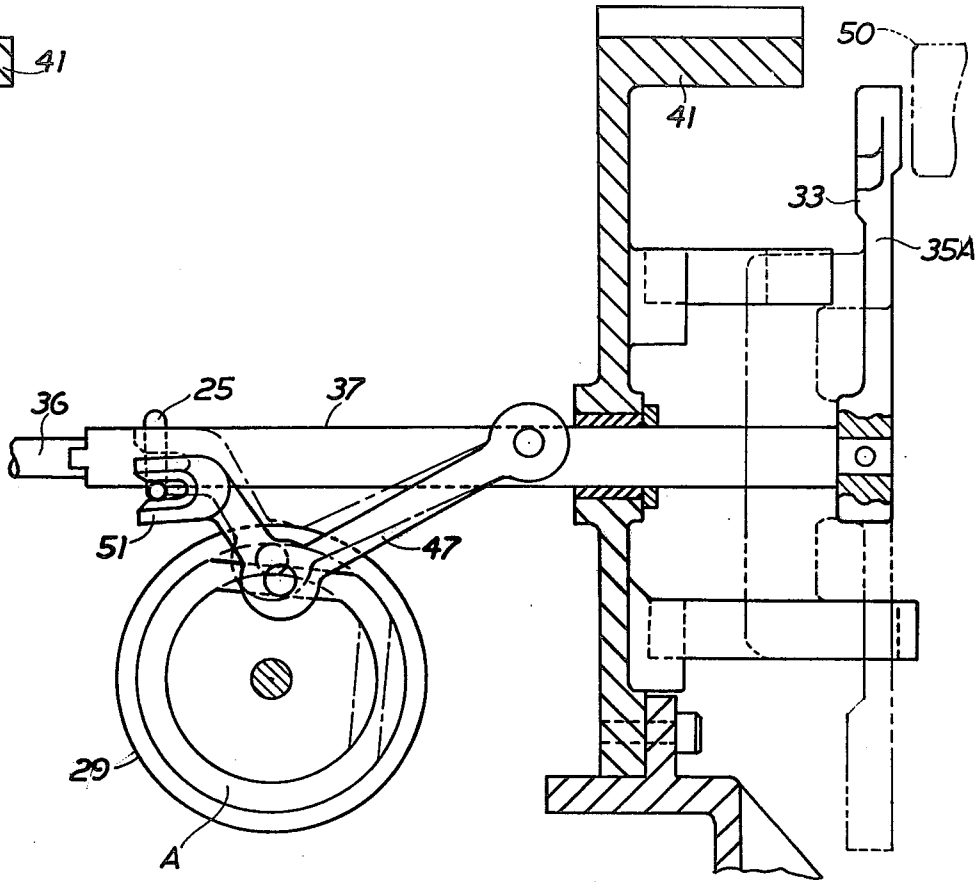
FIG. 4*a* is a vertical sectional view taken along the lines 4*a*—4*a* of FIG. 3.

Cam Track A functions to move pivotable finger 35 toward stationary finger 33, keeping in mind that the pivotable finger 35 is normally biased by a spring to be away from finger 33 or to be in the open position. Cam Track A serves to move the finger 35 to the closed position as can be seen from FIG. 4.

Cam Track B serves to move the fingers 33 and 35 together in a linear direction. Cam Track B can be seen in FIGS. 1 and 5.

Figure 6:
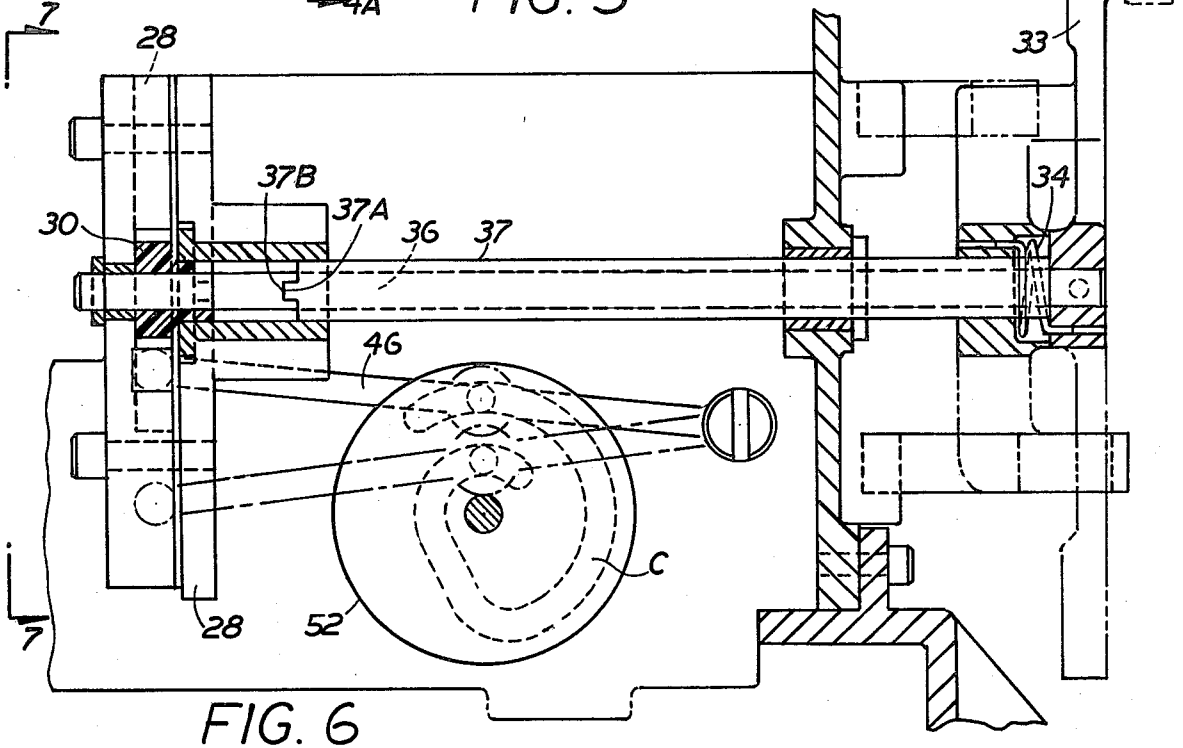
FIG. 6 is a sectional view taken through the lines 6—6 of FIG. 3.
Figure 7:
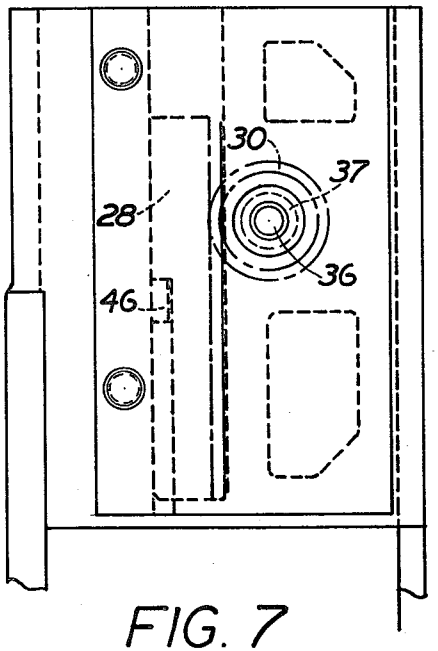
FIG. 7 is a sectional view taken along the lines 7—7 of FIG. 6.

Cam Track C serves to rotate the fingers 33 and 35 as a unit with Cam Track C being seen in FIG. 6.

At the start of a cycle, the fingers 33 and 35 are in the open position. Upon signal from a control circuit, or other controlling device, the motor 23 (FIG. 2) will turn cams 29 and 52 for 360° in a clockwise sense. The open fingers 33 and 35 will move as a unit under the guidance of cam track B toward a bobbin case 50 which is operatively connected to a sewing machine (upper portion of FIG. 1). The cam track B (FIG. 5) acts upon the pivot arm 45 that pushes collar 44 which is fastened to outer shaft 37.

Figure 4A:
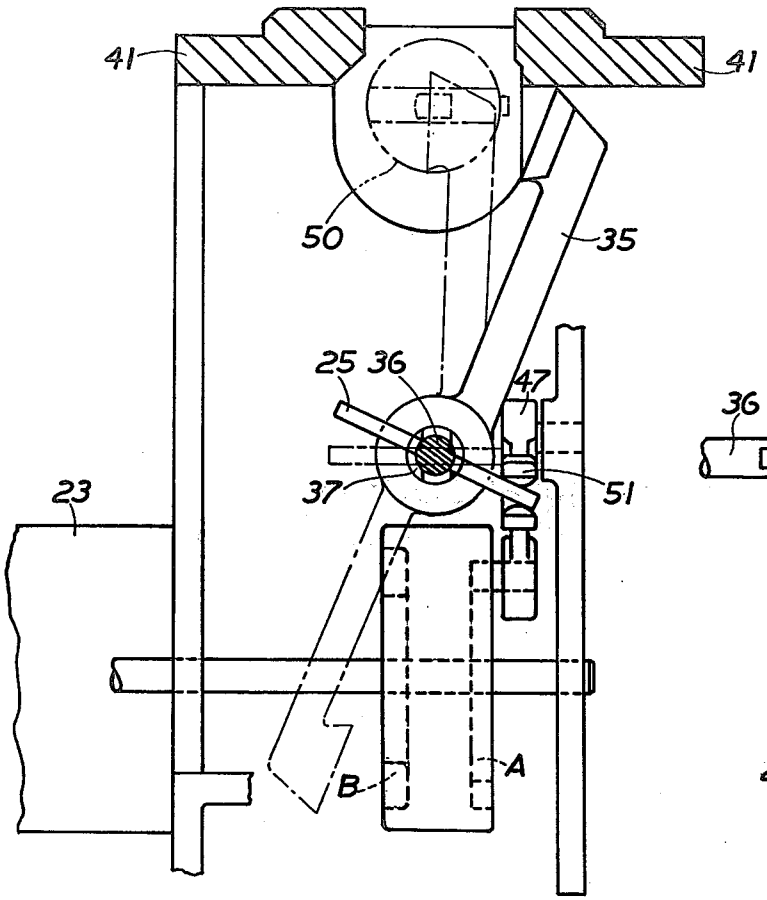

As cam track B goes into dwell, cam track A (FIG. 4) is now lifting pivot arm 47 along with yoke 51. The lifting of yoke 51 in turn lifts pin 25 which causes the rotation of inner shaft 36. This in turn rotates the pivotable finger 35 that is pinned to shaft 36 (FIG. 4A).

As previously noted, the finger 35 will move against the pressure of a spring whereby the finger 35 moves closely adjacent to but past stationary finger 33 (FIG. 12) to lift latch 48 of bobbin case 50. This also holds the latch 48 against the stationary finger 33.

Figure 5:
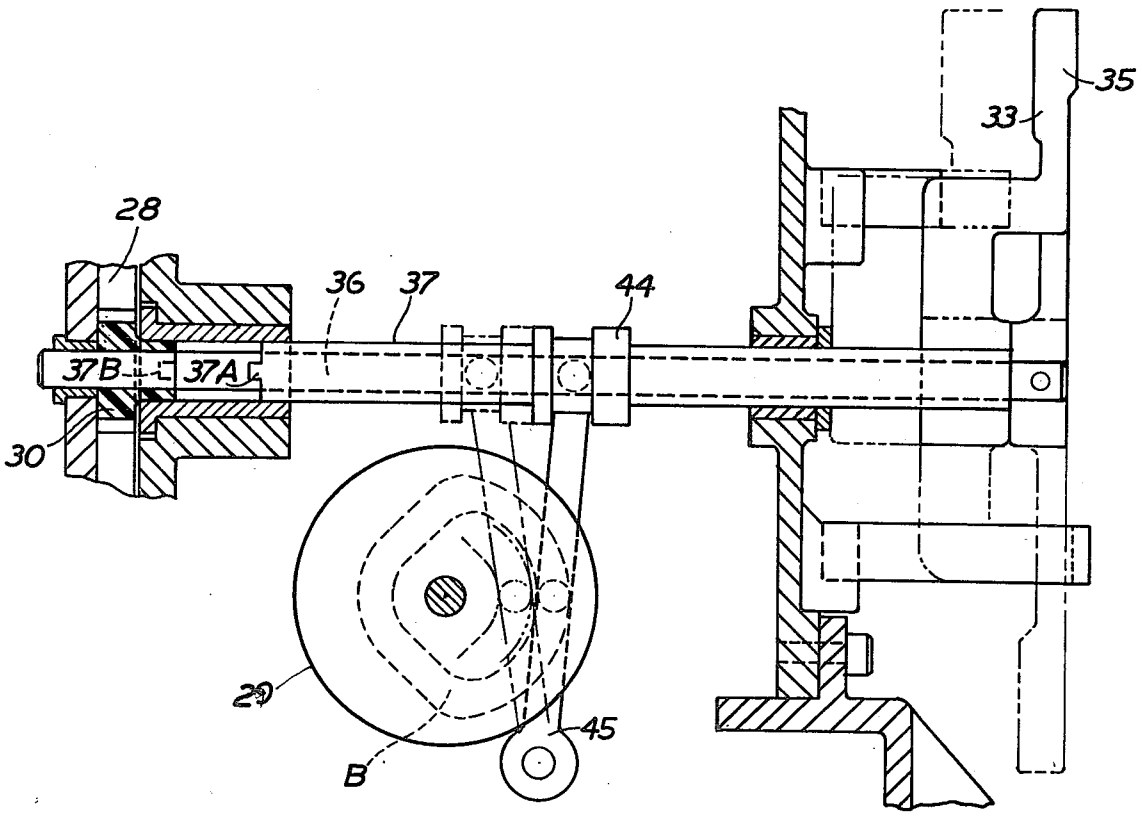
Figure 9:
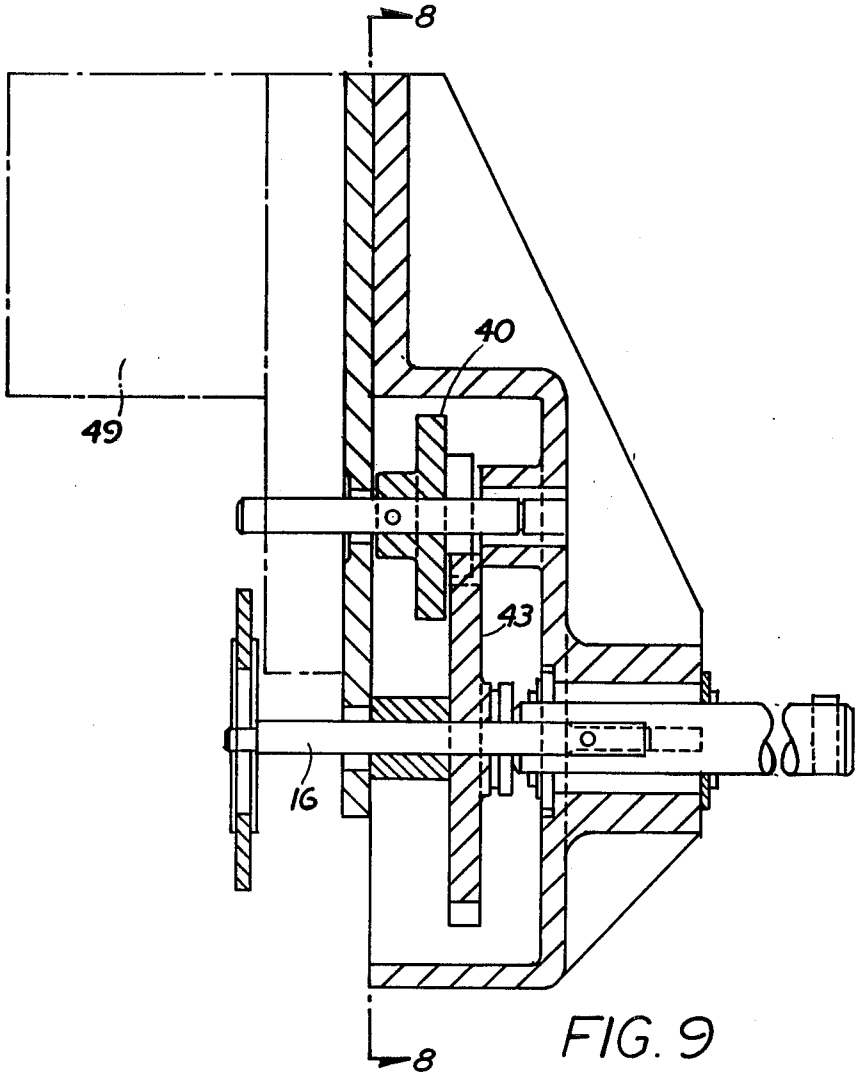
FIG. 9 is a sectional view taken along the lines 9—9 of FIG. 8.
Figure 8:
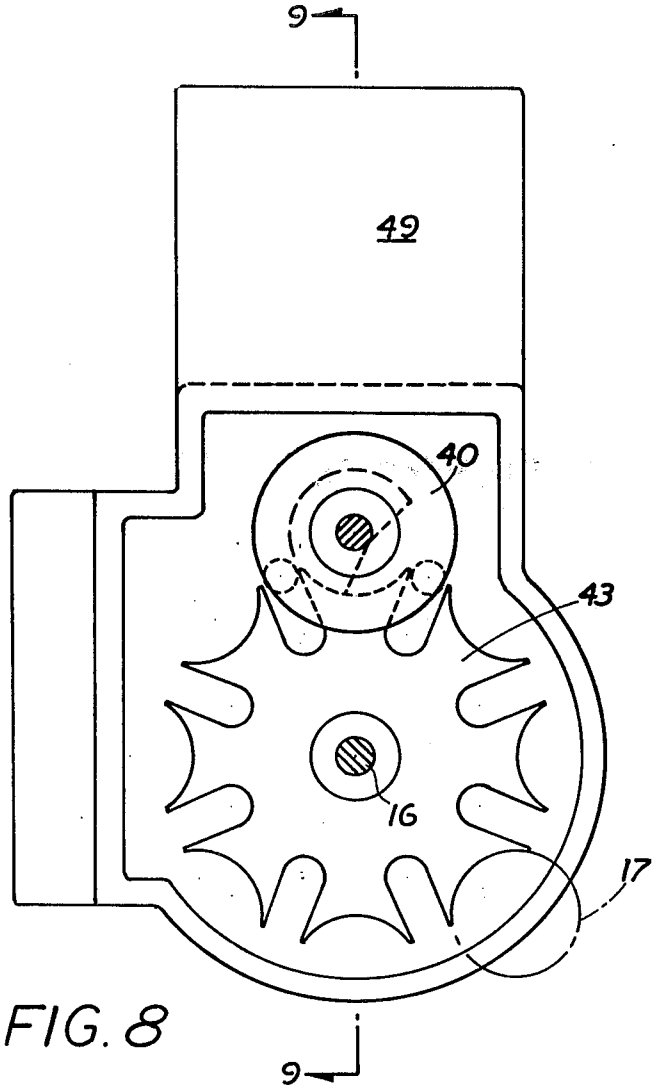
FIG. 8 is a view showing the indexing for the cartridge.

The cam track B now comes off the dwell and continues to move arm 45 (FIG. 5). This causes the collar 44 to move fingers 33 and 35 in a linear sense for $\frac{5}{8}$ of and inch (1.5875 cm) with the bobbin case 50 securely held by the moving fingers 33 and 35. The outer shaft 37 now engages the gear 30 (FIG. 5) and the cam track B goes into dwell again.

As the motor 23 continues to turn, the cam track C now comes into play. The action of cam track C serves to lift arm 46 (FIG. 6) upwardly for 0.981 inches. The upward movement of arm 46 lifts gear rack 28 which turns gear 30, which rotates the shafts 36 and 37 for 180°. It should be noted that the shafts 36 and 37 rotate together when tab 37A on shaft 37 engages notch 37B (FIG. 6). The fingers 33 and 35 with the associated bobbin case 50 are accordingly rotated for 180° to be directly in line with an empty cartridge 17 for disposal or selection of a cartridge of the same or another color. The cam track C now puts arm 46 in dwell. Cam track B starts to move from the dwell position, thereby moving arm 45 with collar 44 forwardly. This has the effect of bringing fingers 33 and 35 with the bobbin case for $\frac{5}{8}$ of an inch (1.5875 cm) toward the cartridge 17.

As the shafts 36 and 37 rotate, the pin 25 enters the yoke 51. When the fingers 33 and 35 have completed the movement toward cartridge 17, the cam track B puts the arm 45 in dwell. Cam track A now comes out of dwell and lifts arm 47 which lowers yoke 51. This in turn rotates inner shaft 36 to allow the finger 35 to pivot away from stationary finger 33 to the open position under the bias of the spring.

Cam track A now comes into dwell. Cam track B moves arm 45 to retract the open fingers 33 and 35 for 1/16 of an inch (0.058 cm).

This completes the first half of the cycle which is to remove the unwanted bobbin case and to place it in the cartridge 17. The mini-computer or control device now selects a new bobbin case to be used. This is done by activating motor 49. The motor 49 turns geneva drive 40 which in turn drives geneva escapement 43 which is pinned to the shaft 16.

Figures 10, 10A:
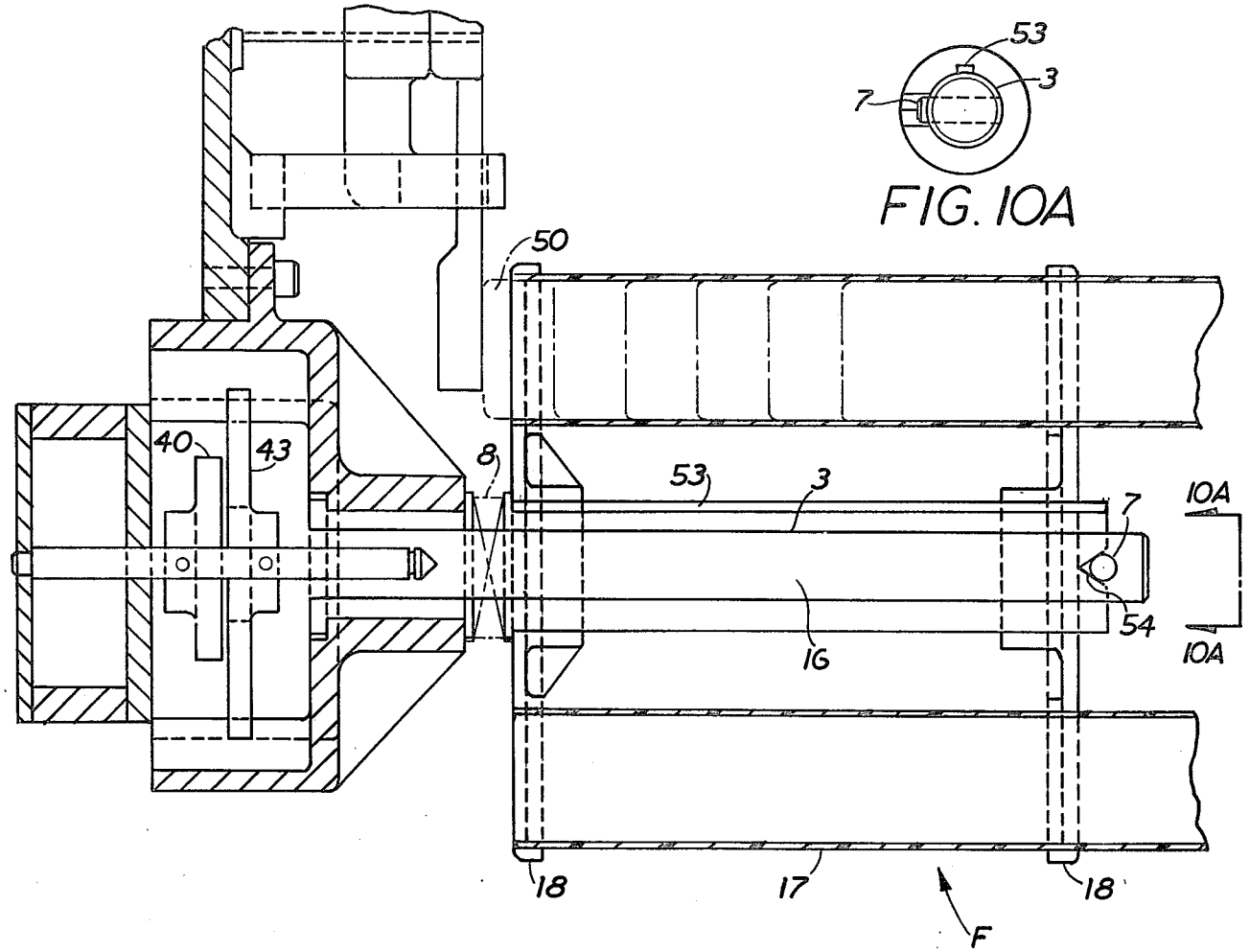
FIG. 10 is a fragmentary section view showing details of the cartridge and its drive mechanism.
FIG. 10A is a view showing details of FIG. 10.

As seen in FIGS. 10 and 11, the magazine reel assembly F is mounted on shaft 16 for rotation therewith. The magazine reel assembly F may consist of eight cartridges, although the number of cartridges is strictly a matter of choice that will be selected by the designer, according to the particular needs. Each cartridge 17 is supported by separators 18 with two of the separators being fastened to the bushing 3, thereby constituting one magazine reel assembly F.

Each cartridge 17 will have a guide rod 15 (FIG. 11) with groove 52 at the end thereof. The groove 52 corresponds to a pin in the sewing machine hook assembly.

Guide rod 15 is anchored at the rear end of holder 9 which is fastened at the end of cartridge 17. The bias spring 11 is fitted about holder 9. The bias spring 11 is biased against the bobbin case pusher 14 which pusher 14 slides freely about guide rod 15. The pusher 14 will contact the innermost bobbin case 50. In one embodiment of the invention each cartridge 17 holds ten bobbin cases 50.

Bushing 3 has a key slot 53 (FIG. 10*a*) running through the entire length of the bushing. As seen in FIG. 11, the shaft 16 has a protruding pin 7 which pin fits in the key slot 3.

In order to insert the magazine F it is necessary to align the key slot 53 with the pin 7, and slide the magazine F home. This is followed by pushing the magazine F an additional $\frac{1}{8}$ of an inch (1.5875 cm) against the bias spring 8 and turning the magazine F for 90° so that the pin 7 will be aligned with slot 54 in the bushing 3. When the magazine F is released, it will be locked to the shaft 16 by virtue of the pressure of spring 8 against the magazine F.

In the preferred mode of operation, four cartridges 17 are completely filled with threaded bobbins 50 and four cartridges 17 are empty. The full four cartridges can obtain threads of different colors as determined by the particular operation. The four empty cartridges will receive empty of partly full bobbin cases. The capacity of each cartridge is ten bobbin cases. In another preferred embodiment (not shown) there are a total of five cartridges. Four of the cartridges (at the start of the operation) are completely filled with threaded bobbins of varied colors. For instance, one cartridge will contain only bobbin wound with red thread, a second cartridge will contain only blue threaded bobbins, a third cartridge will contain only green threaded bobbins and a fourth cartridge will contain only white threaded bobbins. In some cases, two or more cartridges will contain bobbins with threads of the same color. The control circuit can be so programmed that the empty cartridge will receive only empty bobbin cases and with bobbins still containing the same thread being returned to the cartridge having bobbin cases of the same color of thread for use at a later time. As the empty cartridge becomes filled with empty bobbin cases, a collection means can be provided into which the empty bobbin cases are dropped or collected for winding of new thread.

Returning now to the description of the operation, the mini-computer or control device now selects a new bobbin which the device 2 is to insert in the sewing machine. Motor 49 is now stopped and motor 23 beings to operate in the reverse counter-clockwise sense in an automatic action. Cam track B moves arm 45 (FIG. 5) to push collar 44 inwardly 1/16 of an inch (0.3175 cm). In this way, the open fingers 33 and 35 contact the bobbin case device which is being held in one of the cartridges 17. Cam track B goes into dwell and cam track A (FIG. 4) moves arm 47 to lift yoke 51 to cause pin 25 to rotate inner shaft 33, thereby to close the finger 35 which constitutes the grasping action of the bobbin latch by the fingers 33 and 35 (FIG. 13).

Cam track B now comes off dwell and moves arm 45 to push against collar 44 to move the shaft 37 into engagement with gear tooth 37*b*. Cam track B goes into dwell, thereby stopping the arm 45. Cam track C now operates to lift arm 45 and thereby lower gear rack 28 to turn gear 30. Hence, shafts 36 and 37 are rotated 180°. This action rotates fingers 33 and 35 with the inner bobbin case upwardly to the upper position of FIG. 1 so that the bobbin case 50 is in line with the pin and hook assembly of the sewing machine.

Cam track C now puts the arm 46 in dwell. Cam track B begins to move off dwell to move arm 46 and collar forwardly. In so doing, the blades 33 and 35 are moved linearly. When the pin 25 (FIG. 4) enters yoke 51 the fingers 33 and 35 have moved for $\frac{5}{8}$ of an inch (1.5875 cm) to deposit the new bobbin case in the sewing machine. Cam track B will now put the arm 45 in dwell.

Cam track A comes out to dwell to lift arm 47 which lowers yoke 51 to rotate shaft 36 and move finger 35 away from stationary finger 33. Cam track A now goes into dwell. Cam track B moves arm 45 to retract the open fingers 33 and 35 1/16 of an inch (0.3175 cm) to allow thread clearance around the bobbin case and hook in the sewing machine. All systems are now stopped and placed in a holding condition until the next signal from the mini-computer or control device.

In order to facilitate an understanding of the various movements in the cycle, the following chart is provided:

| Position | Cam Track A (Open and Close) | Cam Track B (Linear Movement) | Cam Track C (Rotational Movement) |
|---|---|---|---|
| Blades Open (1/16" Away From Bobbin Case) motor stopped awaiting signal | Stop | Stop | Stop |
| Open Blades Move 1/16" To Bobbin Case | Dwell | Operates | Dwell |
| Blades Close | Operates | Dwell | Dwell |
| Closed Blades out $\frac{5}{8}$" | Dwell | Operates | Dwell |
| Closed Blades Rotate 180° | Dwell | Dwell | Operates |
| Closed Blades Move $\frac{5}{8}$" To Reel F | Dwell | Operates | Dwell |
| Blades Open | Operates | Dwell | Dwell |
| Open Blades Move 1/16" away From Reel F and motor stops | Dwell | Operates | Dwell |
| Reel F Rotates operated by motor - automatically turns geneva motor | Stop | Stop | Stop |
| Open blades Move 1/16" To Reel F motor activated automatically (geneva motor stops) | Dwell | Operates | Dwell |
| Blades Close | Operates | Dwell | Dwell |
| Closed Blades Out $\frac{5}{8}$" From Reel F | Dwell | Operates | Dwell |
| Closed Blades Rotate 180° | Dwell | Dwell | Operates |
| Closed Blades Move $\frac{5}{8}$" To Sewing Machine | Dwell | Operates | Dwell |
| Blades Open | Operates | Dwell | Dwell |
| Open Blades Move 1/6" Away From Sewing Machine -all systems stop | Stop | Stop | Stop |

The shapes of the cam tracks A, B and C are generally as shown in the various drawings and such shapes determine the timing of the three movements imparted to finger 35, as well as the dwell times.

From the foregoing, it can be seen that the fingers 33 and 35 constitute first and second grasping means with the cam tracks A, B and C constituting respectively opening and closing means, linear moving means and rotating means. Cam track A may also be regarded as pivoting means for pivotable fingers.

The various components of the automatic color bobbin changer are for the most part made as metal except in the case of some of the bearings and other components which may be metal or plastic. The various types of metal and plastic can be used easily selected by one skilled in the art.

Without further elaboration, the foregoing will so fully illustrate my invention that others may, by applying current or future knowledge, readily adapt the same for use under various conditions of service.

What is claimed as the invention is:

1. An automatic bobbin changer for attachment to a sewing machine, said bobbin changer serving to detach from the sewing machine a first bobbin case having a latch, said bobbin changer involving grasping means constituting first and second grasping fingers, means to open and close said grasping fingers, means to move said grasping fingers between said sewing machine and a storage area, said storage area being comprised of a plurality of cartridges for storing full and empty bobbin cases, said grasping means grasping said bobbin latch, and means to move said grasping means away from said sewing machine whereby said grasping means hold said bobbin cases and carry away said bobbin cases from said sewing machine.

2. The bobbin changer of claim 1 wherein said storage means constitute a rotatable reel.

3. The bobbin changer of claim 1 wherein certain of said cartridges contain a plurality of threaded bobbin cases constituting second bobbin cases and certain other of the cartridges are empty.

4. An automatic bobbin changer for attachment to a sewing machine, said bobbin changer serving to detach from the sewing machine a first bobbin case having a latch, said bobbin changer involving grasping means constituting a first pivotable finger and a second stationary finger which first pivotable finger opens and closes with respect to said second finger, said grasping means grasping said latch, means to move said grasping means away from said sewing machine whereby said grasping means hold said bobbin and carry away said bobbin from said sewing machine, said automatic bobbin changer further includes a rotatable reel constituting cartridges, certain of which contain a plurality of threaded bobbin cases constituting second bobbin cases and certain other of the cartridges are empty, said grasping means serving to detach said first bobbin case to one of the empty cartridges, deposit said first bobbin case in said empty cartridge, grasping a second bobbin case from one of the other cartridges and deliver said second bobbin case to said sewing machine.

5. The automatic bobbin changer of claim 4 wherein said grasping means constitutes a first pivotable finger and a second stationary finger.

6. The automatic bobbin changer of claim 5 including a first cam means to open and close said fingers and second cam means to move said finger together linearly.

7. The automatic bobbin changer of claim 6 and further including a third cam means to rotate said grasping fingers together.

8. The automatic bobbin changer of claim 4 for use in removing from the sewing machine a first bobbin case having a thread of a first color, grasping means to deliver said first bobbin case to said storage area, said grasping means grasping from said storage means a second bobbin case of a second thread color, said grasping means inserting said second bobbin case in said sewing machine.

* * * * *